US010837191B1

(12) United States Patent
Erbes

(10) Patent No.: US 10,837,191 B1
(45) Date of Patent: Nov. 17, 2020

(54) CLEANING HEAD

(71) Applicant: SHASTA INDUSTRIES, INC., Phoenix, AZ (US)

(72) Inventor: Jeremy R. Erbes, Scottsdale, AZ (US)

(73) Assignee: Pentair Water and Pool Spa, Inc., Golden Valley, MN (US)

( * ) Notice: Subject to any disclaimer, the term of this patent is extended or adjusted under 35 U.S.C. 154(b) by 0 days.

(21) Appl. No.: 16/258,872

(22) Filed: Jan. 28, 2019

(51) Int. Cl.
*E04H 4/16* (2006.01)
*E04H 4/12* (2006.01)

(52) U.S. Cl.
CPC ..... *E04H 4/169* (2013.01); *E04H 4/1663* (2013.01); *E04H 4/1245* (2013.01)

(58) Field of Classification Search
CPC ..... E04H 4/169; E04H 4/1663
USPC ..... 4/490
See application file for complete search history.

(56) References Cited

U.S. PATENT DOCUMENTS 5,919,359 A * 7/1999 Bisseker ..... B01D 29/117 210/167.19
6,971,588 B1 12/2005 Tarr et al.
7,979,924 B1 7/2011 Goettl
8,056,155 B1 11/2011 Goettl
8,308,081 B1 * 11/2012 Goettl ..... E04H 4/169 239/204
8,322,908 B1 12/2012 Hartmann
8,533,874 B1 9/2013 Goettl
8,905,625 B2 * 12/2014 Hartmann ..... B01F 5/0212 366/136
9,267,303 B1 2/2016 Goettl
9,702,158 B2 7/2017 Lopez

* cited by examiner

*Primary Examiner* — Christine J Skubinna
(74) *Attorney, Agent, or Firm* — Cahill Law Group LLC

(57) ABSTRACT

A pop-up cleaning head is connectable to a swimming pool pump and is mounted in a swimming pool inner surface. The head has a pressurized extended position and an unpressurized retracted position respectively when pressurized water from the pool pump is connected to, or disconnected from, the cleaning head. The head includes a spring tube having a lower section with a nozzle orifice for directing a high pressure water stream from the swimming pool pump along and adjacent the pool inner surface. The spring tube has an upper section forming a chamber with the lower section and has a vent orifice aligned with the nozzle orifice to permit the high-pressure water stream to emanate from the head through the vent orifice and entrain pool water. The upper section includes passageways communicating with the pool to admit pool water into the chamber to be entrained in the high-pressure water stream emanating from the nozzle. The passageways extend along respective axes that are inclined to the longitudinal axis of the spring tube.

10 Claims, 5 Drawing Sheets

COLUMN LOCATION

ROW LOCATION

CLEANING HEAD

FIELD OF THE INVENTION

This invention relates to swimming pool cleaning systems, and particularly to cleaning pool systems that employ pop-up cleaning heads to direct a stream of high pressure water adjacent a pool surface.

BACKGROUND OF THE INVENTION

Swimming pool cleaning systems frequently employ pop-up cleaning heads that are strategically positioned about the swimming pool floor, steps and possibly sidewalls. These pop-up cleaning heads usually incorporate a cylindrical housing mounted flush within the pool bottom or wall and a spring loaded smaller cylindrical member slidably mounted within the housing and urged by a weight or a coil spring force to withdraw into the housing to thus remain flush with the inner surface of the pool.

A pool pump provides water under pressure which is directed through a distribution valve that strategically directs the higher pressure water to selected groups of pop-up cleaning heads. As the higher pressure water is applied to the cleaning head, the inner cylindrical member extends upwardly within the housing, compressing the coil spring or lifting the weight, and permits water being applied to the head to be directed generally parallel to the adjacent surface of the pool. This stream of water being directed adjacent the pool surface dislodges dirt and debris from the pool surface and thus places it in circulation to ultimately be removed by a pool filtering system. The pop-up heads generally direct this stream of high pressure water adjacent the surface of the pool in a predetermined direction which results in a fan-shaped flow of higher pressure water flowing from the head for a distance sufficient to provide cleaning in its designated area of the pool floor or wall.

When the distribution valve selects a different head or group of heads, the higher pressure water from the pool pump is shut off from the operating cleaning heads, which results in the weight or coil spring retracting the cleaning head and the cleaning head assuming its flush position. Each cycle of extension and retraction of the cleaning head results in an indexing action which rotates the head about its longitudinal axis for a predetermined number of degrees. In this manner, the high pressure stream of water emanating from the head is directed in an adjacent but different direction for each cycle. Over time, the cleaning head will thus cycle a complete 360° resulting in the cleaning of the surface of the pool adjacent to the head.

The efficiency with which the head provides cleaning action depends on a number of factors including the volume of water that is directed by the head during its cleaning action, as well as the pressure of the water being supplied to the head during its cleaning cycle.

It has been found that the cleaning action provided by the stream of water emanating from the pop-up head can be increased through the utilization of a Venturi action wherein the velocity of the water emanating from the head entrains water from the pool through the head and thus increases the volume and effectiveness of the water being directed from the head adjacent the pool surface.

SUMMARY OF THE INVENTION

The cleaning head of the present invention is a pop-up head that is spring-loaded to its closed position and, upon application of water under sufficient pressure from the pool pump, extends upwardly to direct a stream of water from the pool pump in a direction dictated by the opening in the inner cylindrical member or spring tube assembly. The extension, retraction, and indexing of the cleaning head is similar to that described in U.S. Pat. No. 6,971,588 wherein upon application of high pressure water from the pump the spring is compressed and the spring tube assembly extends upwardly into the pool to direct a stream of water out of the orifice along the adjacent surface of the pool. The cycling of the head by compression and subsequent expansion of the spring within the outer housing to raise and retract the spring tube assembly from within the outer housing, and the indexing caused by camming elements are well known in the art. The prior art also provides a spring tube assembly that includes a cap having a plurality of holes or passageways communicating with a chamber in the head to create Venturi action to thus entrain pool water into the issuing stream.

As high pressure water from the pool pump enters the pop-up head and is directed through an orifice, pool water is drawn into the head through the openings or passageways into the chamber and is entrained with the high pressure water exiting the orifice. The resulting flow from the head through the orifice is thus enhanced and the resulting stream flowing over the adjacent surface of the pool is increased. The present invention improves the volume of water being discharged from the head for any given pump pressure as well as directing the issuing stream in a more horizontal path parallel to the adjacent pool surface; further, the width of the issuing stream is increased to result in a substantial increase in the area being cleaned by the stream. The present invention also improves overall pool circulation through increased water distribution.

BRIEF DESCRIPTION OF THE DRAWINGS

The present invention may more readily be described by reference to the accompanying drawings in which.

DETAILED DESCRIPTION OF THE INVENTION

Figure 1:
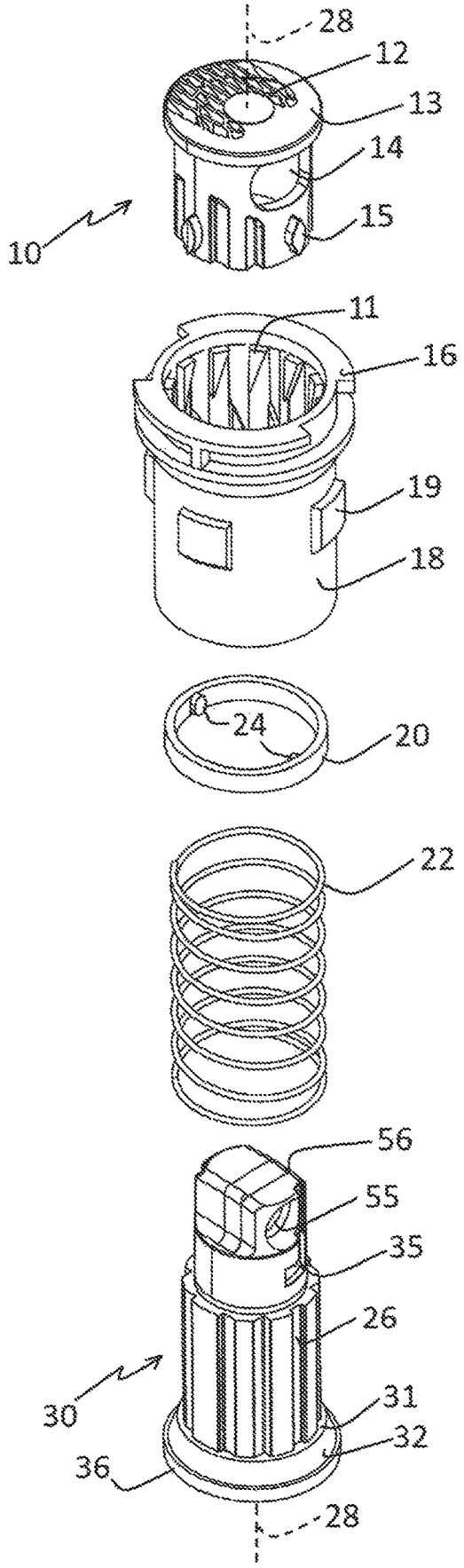
FIG. 1 is a perspective exploded view of a pop-up cleaning head constructed in accordance with the teachings of the present invention.
Figure 2:
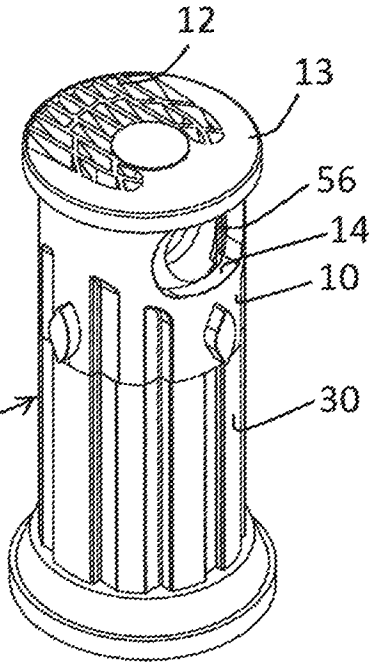
FIG. 2 is a perspective view of the spring tube of the pop-up cleaning head of the present invention.
Figure 3:
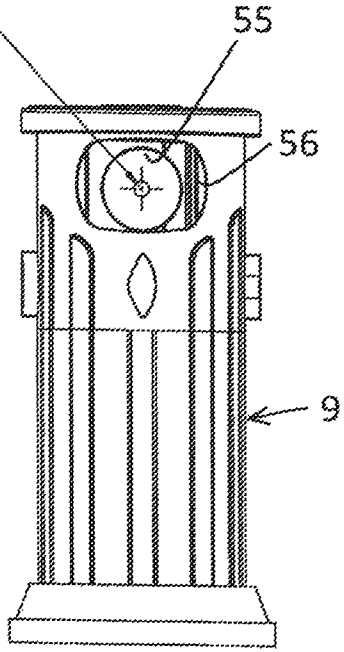
FIG. 3 is a front elevational view of the spring tube of FIG. 2.

FIG. 1 is a perspective exploded view of a pop-up cleaning head constructed in accordance with the teachings of the present invention. When the exploded elements of the pop-up cleaning head of FIG. 1 are assembled, the nozzle or spring tube having spring tube upper section 10 and the spring tube lower section 30 are locked together and appear as shown in FIGS. 2 and 3. Referring to FIG. 1 the pop-up cleaning head includes a spring tube upper section 10 having means defining openings or passageways 12 in the top 13 thereof and a vent orifice 14 for directing a pressured stream of water adjacent the floor or wall surface of the pool in which the head is installed. Vent orifices on prior art Venturi pop-up heads are circular; however, the pop-up head of the present invention incorporates a vent orifice 14 that is oblong having a major axis 25 parallel to the top 13 longer than a minor axis perpendicular to the top 13. Preferably, the vent orifice 14 is obround. It was found that providing this modified orifice shape contributed to the formation of a fan-shaped exiting stream having a greater width than available with prior art Venturi heads. The spring tube upper section 10 is provided with camming elements 15 that cooperate with camming teeth 11 provided in the interior of a housing 18. A spacer 20 is provided that abuts a compression spring 22 and provides an upper seat for the spring. The spacer 20 is provided with guide tabs 24 that ride within guide slots 26 in the spring tube lower section 30.

The spring 22 is positioned over the tube lower section 30 and into contact with a lower spring seat 31, is compressed and contacts the spacer 20. The compression spring 22 urges the spring tube 9 (FIGS. 2 and 3) into its lowered position wherein the spring tube 9 is in a retracted position with the top 13 of the spring tube flush with the upper surface 16 of the housing 18. The housing 18 is provided with locking tabs 19 to secure the pop-up head in position in a pool floor. Water under pressure admitted through the hollow interior of the spring tube 9 compresses the spring 22 and forces the extension of the spring tube 9 to assume an extended position with the spring tube upper section 10 extending upwardly from its position flush with the housing 18 upper surface into the swimming pool. While the embodiment chosen for illustration comprises separate upper and lower sections, and the sections are subsequently joined when inserted into the housing, it may be possible to form the spring tube as a unitary structure through injection molding techniques; however, the utilization of separate upper and lower sections facilitates the assembly of the pop-up head and is therefore the preferred embodiment. Further, the spring 22 may be replaced by a weight to provide sufficient force to urge the pop-up head to its retracted position when the water pressure is lowered ore removed.

An alignment flange 36 is formed in the lower section 30 and includes a sloping or conical surface 32 to engage the interior surface of the housing 18 as the lower section 30 is forced into the housing 18 in response to the application of pump pressure. When the spring tube assembly is forced upwardly by the pressure of the pump water being applied thereto, the sloping surface 32 guides the spring tube into the housing 18 to nest in the bottom opening of the housing. It has been found that the sloping or conical surface 32 may extend at an approximately 45° with respect to the longitudinal axis 28 of the spring tube.

Referring to FIGS. 2 and 3, a chamber 56 is formed by the space between the nozzle orifice structure 56 of the lower spring tube housing 30 and the inside of the top 13 of the spring tube upper section 10 when the top and bottom spring tube sections are locked together. The chamber permits communication of pool water entering the spring tube top passageways 12 and side passageways 17 (FIG. 5*a*) to permit pool water to be entrained in the high pressure water stream emanating from the nozzle orifice 55; the combined high pressure water stream from the nozzle orifice 55 and the entrained pool water in chamber 56 exits the vent orifice 14 to provide a fan-shaped high velocity stream exiting the pop-up head parallel to the adjacent pool surface. When the elements of the pop-up cleaning head of FIG. 1 are assembled, and the upper section 10 and spring tube lower section 30 are locked together as shown in FIGS. 2 and 3, the nozzle orifice 55 of the lower section 30 is aligned with the vent orifice 14 of the upper section 10 such that a water stream emanating from the nozzle orifice 55 is directed through the vent orifice while entraining pool water through passageways 12 and side passageways 17 to provide a fan-shaped stream emanating from the pop-up head. The nozzle orifice 55 in prior art heads is a typical circular opening that directs the high pressure stream of water from the pump through the vent orifice 14; as described above, the vent orifice 14 is not circular as in the prior art but is oval or oblong and preferably an obround shape. The obround shape typically consists of two semicircles connected by parallel lines; the vent orifice 14 of the present invention therefore is preferably obround but may be an oblong shape wherein a major axis 25 of the opening is parallel to the top surface 13 of the upper section 10 and is of greater dimension than a minor axis 21 of the opening perpendicular to the top surface 13.

Figure 4:
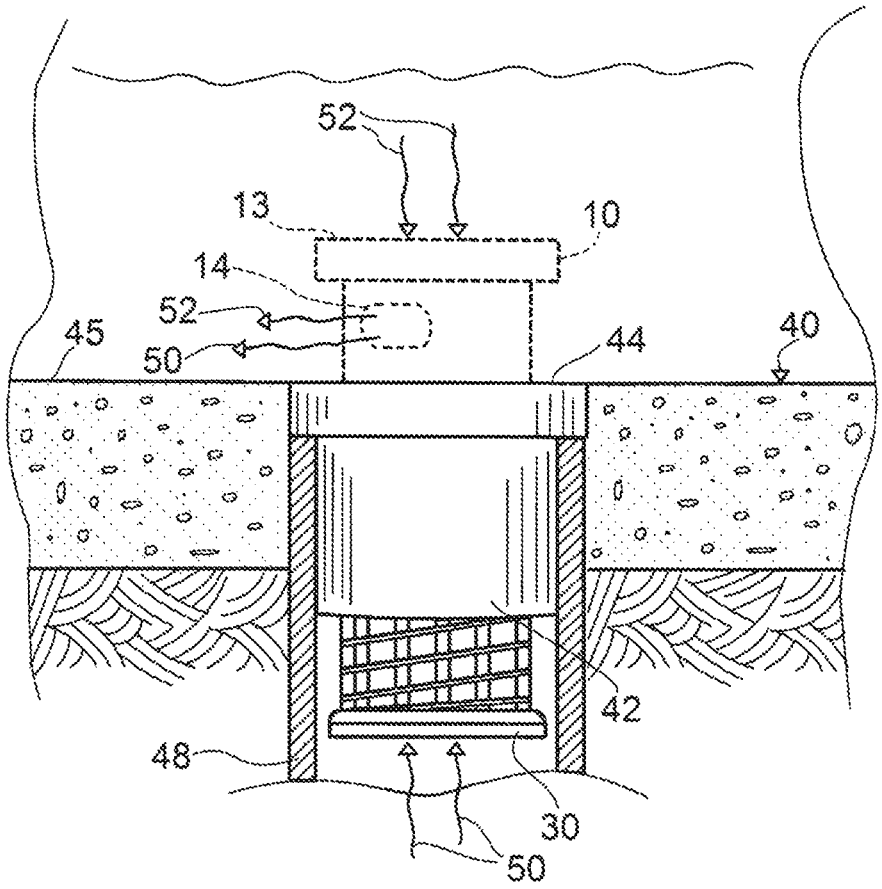
FIG. 4 is a schematic representation of the cleaning head of the present invention positioned in its intended environment mounted in the floor of a swimming pool.

The operation of the pop-up head of the present invention may be facilitated by reference to FIG. 4 wherein the present invention is schematically shown in its intended environment mounted in the floor of a swimming pool. A swimming pool floor 40 is provided with a cylindrical pool fitting 42 positioned in the concrete floor with its upper surface 44 flush with the surface 45 of the pool floor 40. The cleaning head of the present invention may be employed in other interior pool surfaces such as wall surfaces, steps or benches. Therefore, as used herein, the term "pool floor" is intended to include pool walls, steps, benches or other interior pool surfaces. A water supply pipe 48 is secured to the floor fitting while the pop-up cleaning head of the present invention is mounted within the floor fitting. In its quiescent or non-operating state, the spring tube lower section 30 extends slightly beneath the cylindrical pool fitting 42 into the supply pipe 48. When pressurized water is supplied by the pipe to the cleaning head, the spring tube upper section 10, shown in broken lines, extends upwardly into the swimming pool to permit the pressurized water supplied by the pipe to be directed out of the vent orifice 14 adjacent the floor surface of the pool. When water pressure is removed, the spring causes the spring tube 9 to retract to a position wherein the top 13 of the spring tube 9 is again flush with the floor of the swimming pool. Each cycle of extension and retraction of the cleaning head causes an indexing action to rotate the head about its longitudinal axis a predetermined number of degrees for each cycle.

Extension and retraction of pop-up cleaning heads accompanied by such indexing action is well established in the prior art. The present invention incorporates such cleaning head action but greatly increases the efficacy of the cleaning provided by the water emanating from the pop-up head of the present invention. Pressurized water enters the cleaning head as indicated by the arrows 50 and is directed out of the vent orifice 14. Pool water 52 is drawn into the upper section 10 through the openings or passageways 12 in the top 13 of the upper section 10 (FIG. 1) and side passageways 17 by Venturi action and becomes part of the water stream emanating from the vent orifice 14. Thus, pool water and high pressure water are combined and directed from the pop-up cleaning head.

Figure 5B:
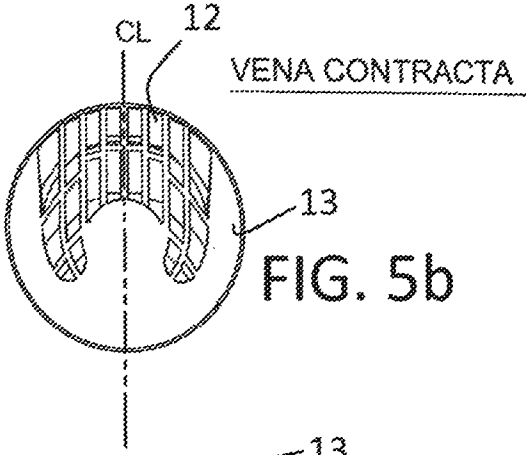
FIG. 5*b* is a top view of the upper section of the spring tube of FIGS. 2 and 3.
Figure 5A:
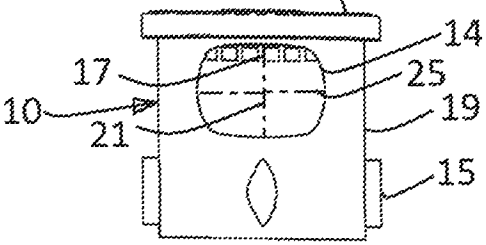
FIG. 5*a* is a front elevational view of the upper section of the spring tube of FIGS. 2 and 3.
Figure 5C:
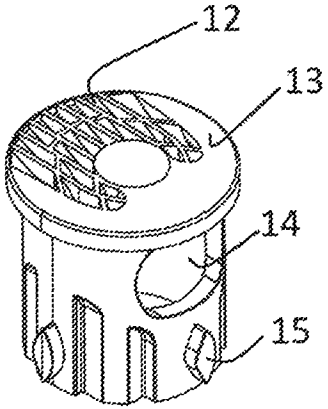
FIG. 5*c* is perspective view of the upper section of the spring tube shown in FIGS. 2 and 3.
Figure 6A:
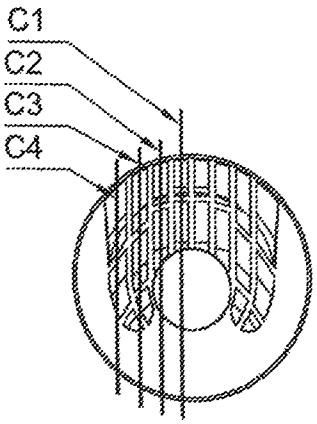
FIGS. 6*a* and 6*b* are top views of the upper section of the spring tube of the present invention showing the column locations and row locations, respectively, of the passageways in the spring tube upper section.
Figure 6B:
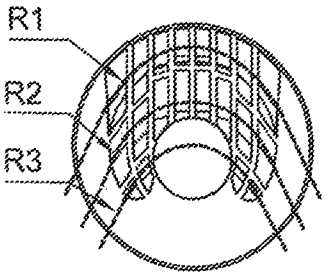
Figure 7:
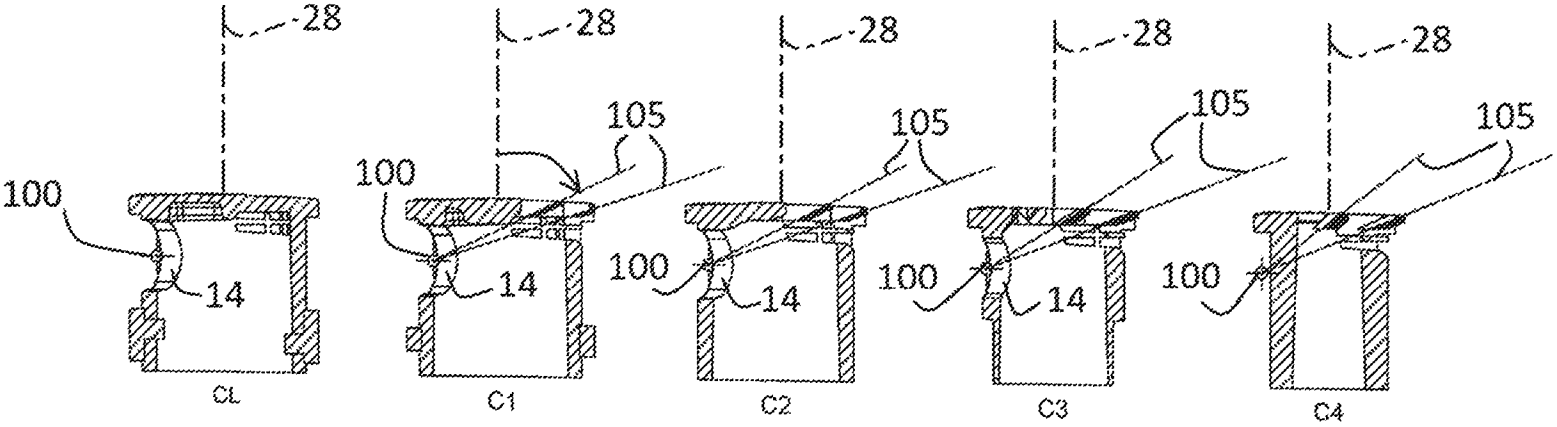
FIG. 7 is an illustration of successive cross-sections of the spring tube upper section of FIG. 6 taken along a center plane and planes of aperture columns of FIG. 6*a*.

Referring to FIGS. 5*a*, 5*b* and 5*c*, the spring tube upper section 10 is shown in front elevational view in FIG. 5*a*, a top view in FIG. 5*b*, and a perspective view in FIG. 5*c*. The spring tube upper section 10 is shown with the oblong or obround vent orifice 14 positioned adjacent the top 13 and passageways 17 are shown in the sidewall 19. Camming elements 15 are shown while passageways 12 are shown in the top 13. The passageways permit communication of pool water into the spring tube upper section to be entrained in the water stream exiting the nozzle orifice 55 (FIG. 1) and passing through the vent orifice 14. The passageways 17 are provided in the cylindrical sidewall 19 of the spring tube upper section 10. The passageways 17 are positioned in the cylindrical sidewall 19 opposite the vent orifice 14 to permit pool water to enter the interior of the spring tube upper section and be entrained in the water stream exiting the vent orifice 14. The passageways 12 are arranged in columns and rows in a manner shown and described in FIGS. 6*a* and 6*b*. Referring to FIG. 6*a*, the passageways are arranged in columns identified as C1, C2, C3 and C4. The passageways 12 are also arranged in rows as indicated in FIG. 6*b*. Referring to FIG. 6*b*, the rows are identified as R1, R2 and R3. Each passageway 12 extending through the top 13 of the spring tube upper section 10 is an opening communicating with the pool water external of the pop-up head and the interior of the spring tube upper section; each passageway extends along a respective axis extending longitudinally of the passageway. The respective axes 105 of the passageways are inclined with respect to the longitudinal axis 28 (FIG. 1) of the pop-up head and are each directed to and extend from the vent orifice 14 and preferably to a focal point generally positioned centrally of the vent orifice 14. In a preferred embodiment the axes 105 are directed to the vena contracta 100 of the water stream exiting the vent orifice 14 (FIG. 7). The vena contracta 100 is the point in the water fluid stream emanating from the vent orifice 14 where the diameter of the stream is the least, and the fluid velocity at that point is at a maximum. Generally, the vena contracta 100 occurs at the maximum concentration of the stream and the diameter of the stream is at its least and occurs slightly downstream of the orifice 14. In the preferred embodiment the respective axes of the individual passageways are aimed directly at the vena contracta; the angle $\alpha$ of the respective axes measured from the axis 28 of the pop-up head thus varies according to the position of the passageway in the top of the spring tube upper section 10. Referring to FIG. 7, successive cross-sections of the spring tube upper section are shown taken along a center plane CL that has no apertures and the planes of aperture columns C1, C2, C3 and C4. The inclination of the respective passageway axes 105 with respect to the longitudinal axis 28 of the pop-up head thus depends on the position of the passageway in the top of the head. The angle $\alpha$ of the respective axis 105 with respect to the axis 28 thus decreases as the position of the passageway approaches the vent orifice 14 and the vena contracta 100. Thus, in FIG. 7, the successive cross-sections of the spring tube upper section are shown beginning with the center cross-section CL where no passageways exist and through successive cross-sections C1, C2, C3 and C4 illustrating the respective axes 105 of the passageways and the alignment of those passageways axes with the vent orifice 14 and the vena contracta 100. None of the axes 105 are parallel to any of the other axes.

The arrangement of and the inclination of the passageway axis 105 with respect to the longitudinal axis 28 of the head, and the direction of those axes to a central focal point positioned in the vent orifice, and preferably to the vena contracta, results in an improved discharge angle of the water emanating from the head; that is, the discharge water stream follows a true horizontal path over the pool floor. The improved discharge water path provides a longer observed cleaning pattern and a substantially increased cleaning area. The increased volume of water resulting from the Venturi action by drawing pool water into the top and side passageways of the spring tube results in enhanced overall pool circulation through increased water distribution. This increase in pool circulation increases the cleaning action of Applicant's system. Further, the inclination of the respective axes of the passageways in the pop-up head of the present invention provides an unexpected advantage when the pop-up head is to be utilized in shallow water; for example, when the pop-up head is placed on a step within the pool and the distance from the pop-up head to the water surface of the pool is less than when the pop-up head is mounted in the pool floor. Prior art pop-up heads that utilize the Venturi principle with openings or passageways in the head generally withdrew water from the pool into the head using Venturi action wherein the passageways have respective axes generally parallel to the longitudinal axis of the head. When the prior art head is mounted in shallow water, the water drawn into the head through Venturi action provided a column-like pattern wherein a vortex effect would be produced on the surface of the water resulting in air being pulled into the head and disrupting the cleaning process. The inclination of the respective axes of the passageways in the head of the present invention prevents the development of such vortexes when the heads are mounted in shallow water.

The present invention has been described in terms of selected specific embodiments of the apparatus incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed:

1. A pop-up cleaning head connectable to a swimming pool pump for mounting in a pool fitting in a swimming pool inner surface, said head having a pressurized extended position and an unpressurized retracted position wherein pressurized water from said pool pump is connected to, or disconnected from, respectively, said cleaning head, comprising:

(a) a housing for mounting in said pool fitting, when mounted said housing flush with said pool inner surface;

(b) a spring tube mounted in said housing and having a pressurized position extending along a longitudinal axis thereof from said housing into said swimming pool and having an unpressurized retracted position flush with said housing and said swimming pool inner surface;

(c) said spring tube having a lower section with a nozzle orifice for directing a high pressure water stream from said swimming pool pump along an adjacent pool inner surface and an upper section forming a chamber with said lower section and having a vent orifice therein aligned with said nozzle orifice to permit said high pressure water stream to exit the head through said vent orifice;

(d) said spring tube upper section having a plurality of passageways therein communicating with said pool to admit pool water into said chamber to be entrained in said high pressure water stream from said nozzle whereby a stream of water is directed from said cleaning head and includes the high pressure stream of water from the nozzle and entrained pool water from said passageways;

(e) each of said passageways having an axis inclined to the longitudinal axis of the spring tube; and (f) each of the axes of the respective passageways extending from and directed to said vent orifice and extending from a focal point positioned centrally of said vent orifice.

2. A pop-up cleaning head connectable to a swimming pool pump for mounting in a pool fitting in a swimming pool inner surface, said head having a pressurized extended position and an unpressurized retracted position wherein pressurized water from said pool pump is connected to, or disconnected from, respectively, said cleaning head, comprising:

(a) a housing for mounting in said pool fitting, when mounted said housing flush with said pool inner surface;

(b) a spring tube mounted in said housing and having a pressurized position extending along a longitudinal axis thereof from said housing into said swimming pool and having an unpressurized retracted position flush with said housing and said swimming pool inner surface;

(c) said spring tube having a lower section with a nozzle orifice for directing a high pressure water stream from said swimming pool pump along an adjacent pool inner surface and an upper section forming a chamber with said lower section and having a vent orifice therein aligned with said nozzle orifice to permit said high pressure water stream to exit the head through said vent orifice;

(d) said spring tube upper section having a plurality of passageways therein communicating with said pool to admit pool water into said chamber to be entrained in said high pressure water stream from said nozzle whereby a stream of water is directed from said cleaning head and includes the high pressure stream of water from the nozzle and entrained pool water from said passageways;

(e) each of said passageways having an axis inclined to the longitudinal axis of the spring tube; and (f) each of the axes of the respective passageways extending from and directed to said vent orifice and wherein each of said passageways are inclined at an angle with respect to the longitudinal axis of the spring tube, the angle of the respective passageways decreasing as the position of the passageway approaches said vent orifice.

3. A pop-up cleaning head connectable to a swimming pool pump for mounting in a pool fitting in a swimming pool inner surface, said head having a pressurized extended position and an unpressurized retracted position wherein pressurized water from said pool pump is connected to, or disconnected from, respectively, said cleaning head, comprising:

(a) a housing for mounting in said pool fitting, when mounted said housing flush with said pool inner surface;

(b) a spring tube mounted in said housing and having a pressurized position extending along a longitudinal axis thereof from said housing into said swimming pool and having an unpressurized retracted position flush with said housing and said swimming pool inner surface;

(c) said spring tube having a lower section with a nozzle orifice for directing a high pressure water stream from said swimming pool pump along an adjacent pool inner surface and an upper section forming a chamber with said lower section and having a vent orifice therein aligned with said nozzle orifice to permit said high pressure water stream to exit the head through said vent orifice;

(d) said spring tube upper section having passageways therein communicating with said pool to admit pool water into said chamber to be entrained in said high pressure water stream from said nozzle whereby a stream of water is directed from said cleaning head and includes the high pressure stream of water from the nozzle and entrained pool water from said passageways;

(e) each of said passageways having an axis inclined to the longitudinal axis of the spring tube; and (f) each of the axes of the respective passageways directed to and extending from a vena contracta of the water stream emanating from the head.

4. The swimming pool pop-up cleaning head of claim 3 wherein each of said passageways are inclined at an angle with respect to the longitudinal axis of the spring tube, the angle of the respective passageways decreasing as the position of the passageway approaches said vent orifice.

5. The swimming pool pop-up cleaning head of claim 3 wherein said nozzle orifice is circular and said vent orifice is oblong having a major axis parallel to a top surface of said upper section and a minor axis perpendicular to said top surface of said upper section.

6. The swimming pool pop-up cleaning head of claim 3 wherein said nozzle orifice is circular and said vent orifice is obround.

7. A pop-up cleaning head connectable to a swimming pool pump for mounting in a pool fitting in a swimming pool inner surface, said head having a pressurized extended position and an unpressurized retracted position wherein pressurized water from said pool pump is connected to, or disconnected from, respectively, said cleaning head, comprising:

(a) a housing for mounting in said pool fitting, when mounted said housing flush with said pool inner surface;

(b) a spring tube mounted in said housing and having a pressurized position extending along a longitudinal axis thereof from said housing into said swimming pool and having an unpressurized retracted position flush with said housing and said swimming pool inner surface;

(c) said spring tube having a lower section with a nozzle orifice for directing a high pressure water stream from said swimming pool pump along an adjacent pool inner surface and an upper section forming a chamber with said lower section and having a vent orifice therein aligned with said nozzle orifice to permit said high pressure water stream to exit the head through said vent orifice;

(d) said spring tube upper section having top passageways extending through a top thereof and side passageways extending through a side thereof communicating with said pool to admit pool water into said chamber to be entrained in said high pressure water stream from said nozzle whereby a stream of water is directed from said cleaning head and includes the high pressure stream of water from the nozzle and entrained pool water from said passageways;

(e) each of said top passageways having an axis inclined to the longitudinal axis of the spring tube; and (f) each of the axes of the respective top passageway directed to and extending from a vena contracta of the water stream emanating from the head.

8. The swimming pool pop-up cleaning head of claim 7 wherein each of said top passageways are inclined at an angle with respect to the longitudinal axis of the spring tube, the angle of the respective passageways decreasing as the position of the passageway approaches said vent orifice.

9. The swimming pool pop-up cleaning head of claim 7 wherein said nozzle orifice is circular and said vent orifice is oblong having a major axis parallel to a top surface of said upper section and a minor axis perpendicular to said top surface of said upper section.

10. The swimming pool pop-up cleaning head of claim 7 wherein said nozzle orifice is circular and said vent orifice is obround.

* * * * *